United States Patent [19]

Budmiger

[11] 4,195,422

[45] Apr. 1, 1980

[54] SYSTEM FOR SIMULATING WEAPON FIRING

[75] Inventor: Hermann Budmiger, Seewen, Switzerland

[73] Assignee: Laspo AG, Diessenhofen, Switzerland

[21] Appl. No.: 859,723

[22] Filed: Dec. 12, 1977

[30] Foreign Application Priority Data

Dec. 20, 1976 [CH] Switzerland ..... 16225/76
May 27, 1977 [CH] Switzerland ..... 6668/77

[51] Int. Cl.[2] ..... F41F 27/00
[52] U.S. Cl. ..... 35/25; 273/310
[58] Field of Search ..... 35/25; 273/101.1, 102.2 R

[56] References Cited

U.S. PATENT DOCUMENTS

| | | | |
|---|---|---|---|
| 3,214,173 | 10/1965 | Garcia Vidal | 273/101.1 |
| 3,633,285 | 1/1972 | Sensney | 273/101.1 X |
| 3,655,192 | 4/1972 | Hall et al. | 273/101.1 |
| 3,838,856 | 10/1974 | Takeya et al. | 273/101.1 |
| 3,938,262 | 2/1976 | Dye et al. | 35/35 |
| 4,048,489 | 9/1977 | Giannetti | 273/101.1 X |
| 4,054,290 | 10/1977 | Villa | 273/101.1 |

*Primary Examiner*—William H. Grieb
*Attorney, Agent, or Firm*—Werner W. Kleeman

[57] ABSTRACT

A system for simulating weapon firing comprising a pulse transmitter connected with a weapon for transmitting beam pulses and a target device having a hit display. The pulse transmitter comprises a calibrated adjustment device for the beam pulses in order to adjust the hit diameter at the target image plane of the target device to the caliber of the weapon.

24 Claims, 9 Drawing Figures

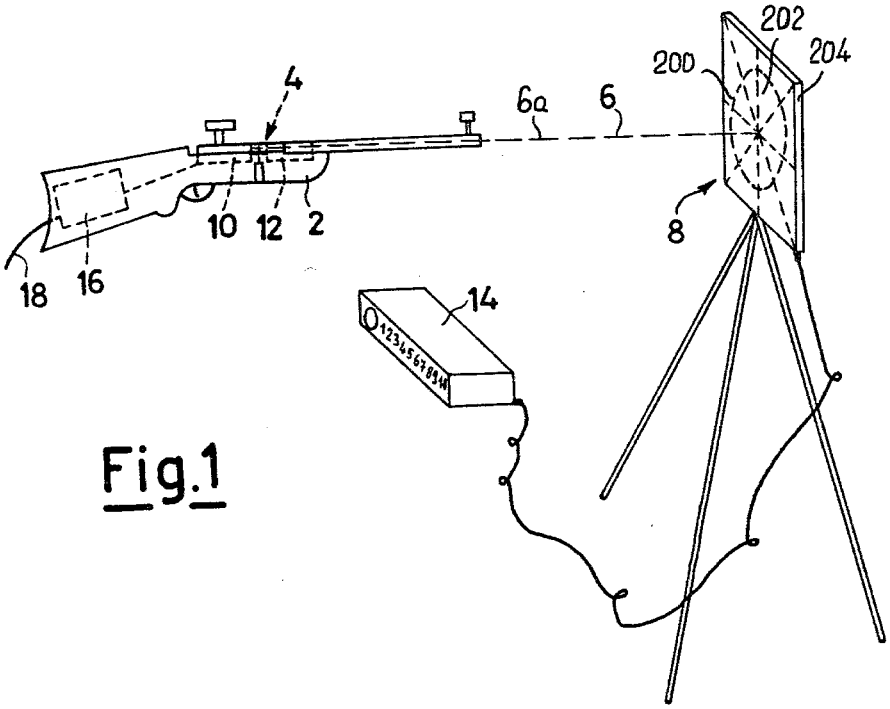
Fig.1
Fig.2
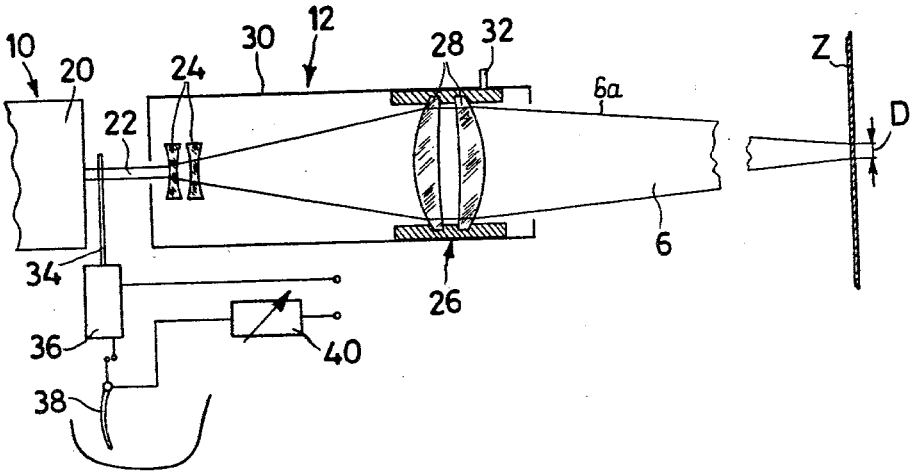

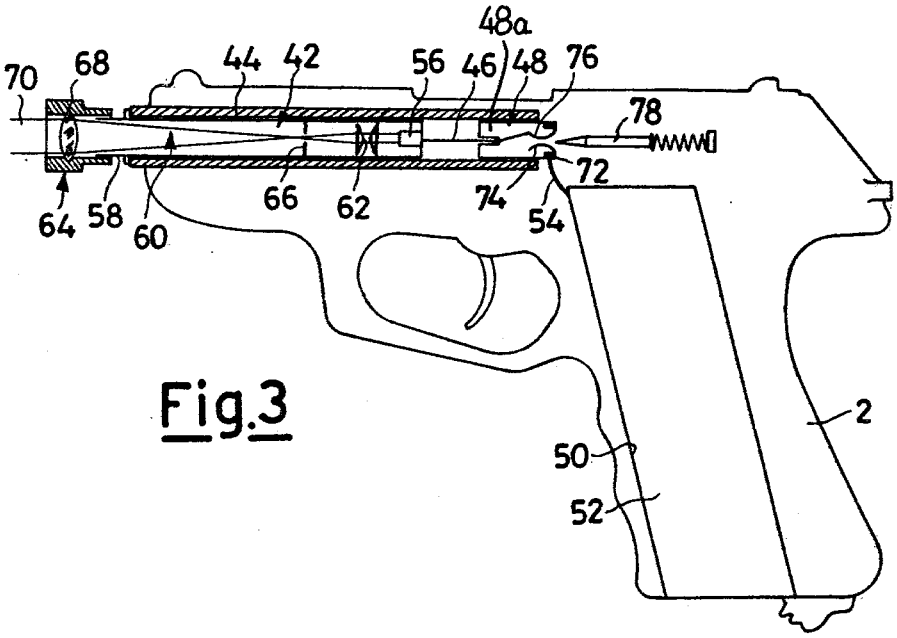
Fig.3
Fig.6
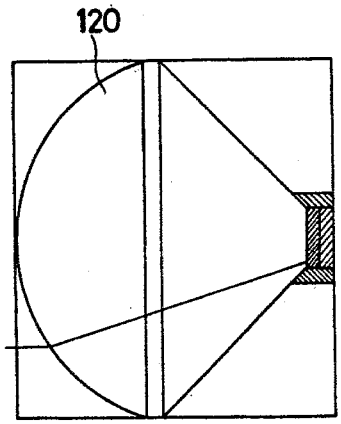
Fig.7
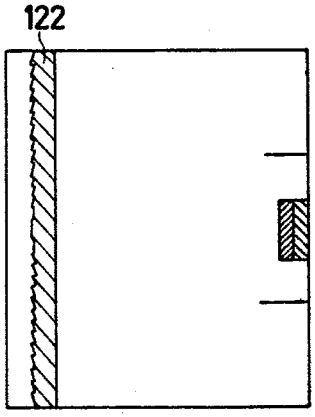

Fig.8
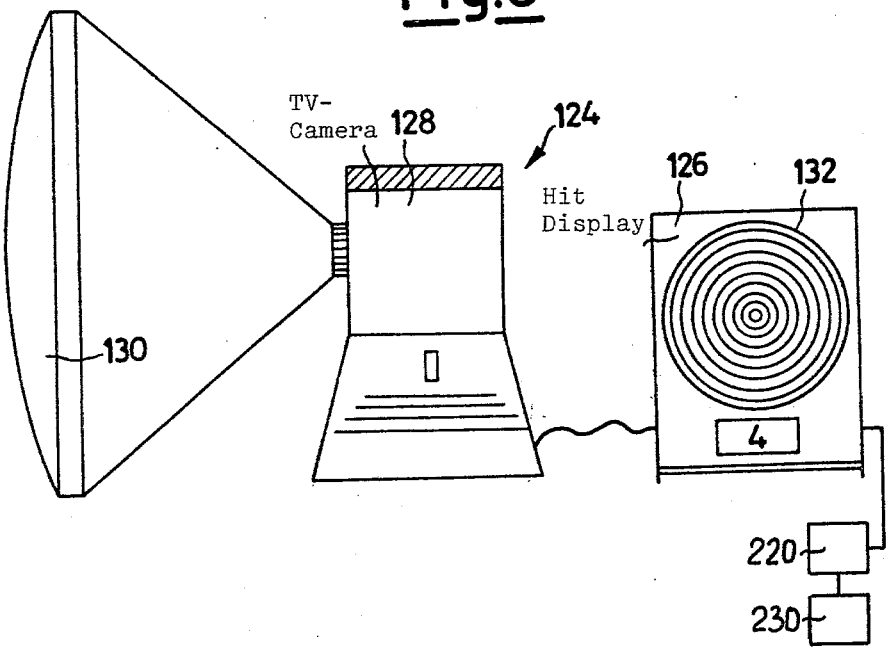
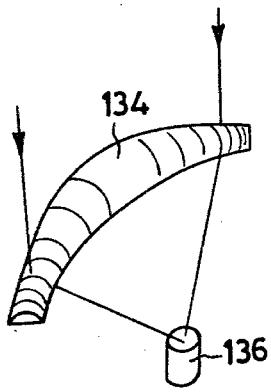
Fig.9

SYSTEM FOR SIMULATING WEAPON FIRING

BACKGROUND OF THE INVENTION

The present invention relates to a new and improved weapon training system, and more specifically, pertains to a system or installation for simulating firing of a weapon, which is of the type comprising a pulse transmitter connected with the weapon for transmitting beam pulses and a target device having a hit display.

Installations of the previously mentioned type are known to the art, but have the notable drawback that they are not suitable for the actual simulation of weapon firing, especially sportsman shooting. Firstly, the beam pulse emanating from the weapon is divergent, so that it does not correspond to the caliber of the weapon at the target plane, rather has a greater diameter. Secondly, the beam intensity is too small, so that it is only possible to shoot at a relatively short distance. Finally, there is used as the target device a plate provided with photoelements, which, however, may only have a limited size, since useful photoelements can only be fabricated with very limited dimensions. Larger flat photoelements have defect locations which deliver either attentuated signals or no signals, so that a beam pulse impinging thereat produces an insufficient display or no display at all. Hence, at best, the prior art installation is suitable for simulating shooting at small distances.

SUMMARY OF THE INVENTION

Therefore, with the foregoing in mind, it is a primary object of the present invention to provide an improved system for simulating firing of a weapon in a manner not associated with the aforementioned drawbacks and limitations of the prior art proposals.

Another and more specific object of the present invention aims at an improved system for simulating weapon firing in a highly accurate manner corresponding to the actual firing of a weapon.

Still a further significant object of the present invention relates to an installation for simulating firing of a weapon in a manner such that there is exactly simulated the actual weapon firing conditions.

Now in order to implement these and still further objects of the invention, which will become more readily apparent as the description proceeds, the installation for simulating the firing of a weapon of the previously mentioned type is manifested by the features that the pulse transmitter has an adjustment device for the beam pulses in order to adjust the hit diameter at the target plane of the target device to the caliber of the weapon.

Since the pulse transmitter has a calibrated adjustment device for the beam pulses, in order to adjust their hit diameter at the target plane of the target device to the caliber of the weapon, it is possible to adjust the beam pulse for each distance of the target device such that at the target plane the hit diameter of the beam pulse corresponds exactly to the caliber of the weapon. In this way there is eliminated the inherent divergence of the beam or path of the rays, present for each beam pulse even if the beams are parallelly directed, and furthermore, there is obtained a concentration of the beam pulse at the hit location in the target plane of the target device.

The pulse transmitter can be, for instance, a radiation diode, preferably a laser diode or infrared diode, especially suitable for shorter distances. A pulse transmitter having a radiation diode can be particularly designed as an attachment device with which there can be equipped a conventional weapon without modification. Particularly suitable for simulated firing over larger distances is a laser rod or tube. This can be arranged at or in the weapon. There is also possible an arrangement externally of the weapon, in which case the connection with the weapon can be accomplished by a photoconductor.

The adjustment device of the pulse transmitter preferably comprises a calibrated adjustable optical component or system which advantageously can constitute the objective. The term "optic" and equivalent expressions, as employed herein, should be understood as being used in their most general designation and are not limited only to photo-optical devices, but rather also encompasses electron optical devices.

The pulse transmitter advantageously embodies an optical system for enlarging and focusing a beam pulse. Such optical system is especially suitable for beam generators, i.e., beam-producing devices which transmit practically parallel rays or beams, such as for instance a laser rod or tube. In this way it is possible to enlarge or expand the parallel beams and to focus such into a converging beam pulse which then can be adjusted such that it corresponds at the target plane to the caliber of the weapon.

The pulse transmitter also can embody an optical system having a condenser and an objective having an apertured partition or diaphragm located at their common focal point. Such optical system is especially suitable for use with beam generators which do not have any circular shaped beam source and possibly do not transmit any parallel beams. By means of the condenser the beams are concentrated at a focal point where there is arranged the diaphragm which forms the beam. By means of the successively arranged objective there is then imaged at the target plane the beam which is focused by the diaphragm, and by adjusting the objective it is possible to adjust the diameter of the beam to the caliber of the weapon in the target plane.

With pulse transmitters having an uninterrupted beam, as such is for instance the case for a throughpass laser, such as a laser rod, it has been found to be advantageous to produce the beam pulses by arranging a shutter or closure element at the path of the rays or beam and which is coupled with the trigger of the weapon. The shutter or closure element is preferably disposed between the beam source and the adjustment device for the beam pulses.

A switch for triggering the beam pulse is preferably constructed as a cartridge-like switch insert in the barrel of the weapon and can be actuated by means of a firing pin of the weapon. The firing pin can bring into engagement two contacts arranged in a switch insert or preferably can directly bridge two contacts when the firing pin is in its firing position. The switch insert preferably comprises a sleeve formed of electrically insulating material and has a contact ring disposed at the region of the firing pin. This contact ring cooperates with a contact tab or tongue of a supply device for the pulse transmitter. The switch insert is preferably electrically connected by means of a plug connection with the pulse transmitter. This is especially then advantageous if the pulse transmitter is inserted from the front as a plug-in component into the barrel of a weapon, especially a pistol.

The trigger device for the beam pulse preferably contains an adjustable timing element for adjusting the duration of the beam pulse. This duration is preferably adjusted such that it corresponds to the time between firing a weapon until departure of an actual projectile out of the weapon. In this way there is achieved the result that each movement of the weapon is detected during the triggering or firing thereof, but preferably at the target device there is only detected that part of the beam pulse corresponding to the departure of the projectile out of the weapon barrel, i.e., there is only evaluated the end of the beam pulse. In this manner there is realized an exact simulation of a weapon as during firing with ammunition.

The supply device for the pulse transmitter can be arranged externally of the weapon. However, it is preferably arranged at the weapon, and it is particularly advantageously constructed as a magazine insert for the cartridge magazine of the weapon. A supply device constructed as a magazine insert can be equipped with a contact tab or tongue which is connected with the switching device for triggering the beam pulse.

A particularly advantageous construction of the switching device comprises a piezoelectric device responsive to the impact of the firing pin and serving for triggering the beam pulse. Such construction is particularly then advantageous when a standard weapon should be equipped without modification for simulated firing.

The target device preferably comprises a target image sub-divided at the target region or zone, and at a detector each target region has a sensor responsive to an impinging beam pulse. It is of extreme advantage if the sensor is smaller than the associated target region of the target image. Between the target image plane and the detector constituted by the sensors there is provided an optical device for the deflection and proportional reduction of a beam pulse at the sensors and which impinges upon the target image plane. Consequently, it is possible to equip the detector with extremely small effective sensors and still have a target image of random size. There is also realized a further advantage in that the beam pulse impinging at the target plane is concentrated due to the deflection and proportional size reduction, and thus can be evaluated at the sensors with increased energy. By using such target device it is possible to exactly simulate firing or shooting exercises at the standard distances and standard targets.

Now in the target image plane there is advantageously arranged a collecting lens, for instance a Fresnel lens, an aspherical lens or a facet lens. In the last-mentioned case it is, for instance, not necessary to use a sensor whose surface is proportional to the surface of a facet, rather there can be employed a point-shaped sensor arranged at the focal point of the facet. In order to eliminate foreign or spurious light effects, there is advantageously arranged at the target device an interference filter between the sensors and the target image plane. Such can be, for instance, constructed as an interference filter foil which has the least effect upon the beam or path of the rays. It is particularly advantageous to arrange the interference filter foil at the rear or back face of the collecting lens.

The target device contains mechanism for focusing a target image. There can be advantageously employed for this purpose a partially pervious mirror, with the aid of which there can be focused or concentrated the target image at the beam. The target image can be of random design, advantageously it is a target disk or the like. There also exists the possibility to configure the background of the target device which is behind a collecting lens in the form of a target image.

The sensors are advantageously photo-elements, preferably phototransistors manufactured with silicon. If, for instance, a target disk is to be evaluated as a target image, then such is preferably sub-divided into sectors, and the detector is equipped with sensors corresponding to the ring sections. When using phototransistors the rings can be constructed as the collectors and the sectors as the emitters. One such collector is advantageously connected with an evaluation device containing a first coder or coding mechanism connected with the rings, and a second coder or coding mechanism connected with the sectors, which in each case further transmit to a shift register the coded ring and sector signals corresponding to a hit ring section. Such shift register is connected with a shift register of the hit display. The first coder is preferably constructed such that when there is a hit which strikes two rings it delivers the higher hit value of the ring to the shift register. At the hit display there can be displayed the hit rings and sectors. For this purpose, the hit display is also advantageously equipped with a shift register and decoders. The display at the hit display can be accomplished in analogue or digital manner. It is advantageous to digitally display the ring values. The sector is preferably displayed in analogue manner by means of optical devices or lamps corresponding to the sectors.

An advantageous construction of the target device contains a television camera as the detector and having a collecting lens arranged forwardly thereof at the target image plane. Particularly advantageous are semiconductor television cameras equipped with semiconductor elements correlated to the image regions. As the hit display or hit indicator there can be used a monitor at which there is focused a target image. There is thus produced an exact representation of the hit at the target image. It is advantageous to further equip such hit indicator with a microprocessor which determines the hit ring value and displays such at a digital display.

With the system of the present invention it is possible to exactly simulate conventional shooting or firing conditions. The system is particularly suitable for simulating competitive shooting and training shooting exercises at shooting stands, both with pistols and rifles. In each situation there are obtained equally good results, irrespective whether there is simulated shooting with a rifle or weapon at a distance of 300 meters upon a target disk of 100 cm. or shooting with an air pistol at 10 meters upon a target disk of 10 cm. There is also possible simulation of battle firing conditions, and there can be imaged for this purpose at the target device a random target image. The sensors of the detector can be matched to target regions of the target image. Such target device can be erected at any random location. The system is also suitable for use in closed areas for simulating firing exercises without any danger.

BRIEF DESCRIPTION OF THE DRAWINGS

The invention will be better understood and objects other than other set forth above will become apparent when consideration is given to the following detailed description thereof. Such description makes reference to the annexed drawings wherein:

FIG. 1 schematically illustrates a system or installation for simulated weapon firing;

FIG. 2 is a schematic illustration of the arrangement of a pulse transmitter, a calibrated adjustment device, and a target image plane;

FIG. 3 is a schematic illustration, partially in sectional view, of a conventional pistol modified for simulated firing;

FIG. 6 is a longitudinal, sectional and schematic view of a target device with an aspherical lens;

FIG. 7 is a schematic longitudinal, sectional view of a further construction of target device with a Fresnel lens;

FIG. 8 is a schematic view of a further target device having a television camera and a hit display or indicator constructed as a monitor; and FIG. 9 is a schematic illustration of a facet of a facet lens.

DETAILED DESCRIPTION OF THE PREFERRED EMBODIMENTS

Figure 4:
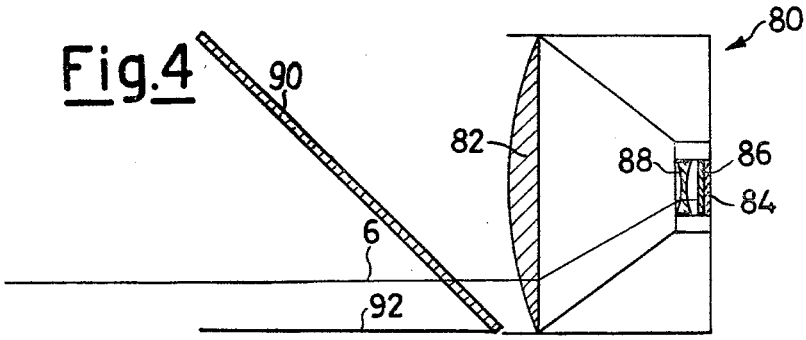
FIG. 4 illustrates in longitudinal sectional and schematic view a target device with focused target image.

Describing now the drawings, FIG. 1 illustrates an exemplary embodiment of installation or system for simulated firing of a weapon 2 constructed as a rifle. This weapon firing simulator will be seen to comprise a pulse transmitter 4 for transmitting a beam pulse 6 defining a beam 6*a* to a target device 8. The pulse transmitter 4 contains a calibrated adjustment device 12 for the beam pulse 6, in order to adjust its hit diameter at the target image plane Z of target device 8 to the caliber of the weapon 2. The target device 8 is furthermore equipped with a hit display or indicator 14 which, in the exemplary embodiment under discussion, digitally displays the hit rings, generally indicated by reference character 200 in FIG. 1, and the hit sectors 202 of the target 204, here shown as a target disk. The pulse transmitter 4 is powered by a supply device 16 arranged in the weapon 2, supply device 16 being connected by means of a conductor or line 18 with any suitable current or power source. In contrast to the illustrated exemplary embodiment it would be also possible to arrange the supply device 16 and possibly the beam source 10 externally of the weapon 2. If the beam source 10 is arranged externally of the weapon 2 then such is to be connected by means of a photoconductor with the adjustment device 12.

Continuing, in FIG. 2 there is illustrated a pulse transmitter which is especially suitable for simulating weapon firing at a greater distance. This pulse transmitter contains as the beam source 10 a laser rod or tube 20 working, for instance, on the basis of helium-neon and delivering an uninterrupted beam 22 to the adjustment device 12. This adjustment device 12 will be seen to contain two dispersion or scattering lenses 24 for enlarging the practically parallel beam 22. At an objective 26 having collecting lenses 28, the enlarged radiation beam is again grouped together and focused. The objective 26 can be displaced within the housing 30 of the adjustment device 12 by means of a handle 32 or other suitable or equivalent displacing means. The displacement path is calibrated such that the delivered beam, generally indicated by reference character 6*a* in FIG. 2, can be adjusted as a function of the distance to the target image plane Z such that the hit diameter D corresponds to the caliber of the weapon 2. In order to transmit a single beam pulse there is arranged in the beam or ray path a shutter or closure member 34 between the laser rod 20 and the adjustment device 12. This closure element 34 in its rest position is always closed and interrupts the beam 6*a*. An electromagnet 36 serves to actuate the closure element or shutter 34, and in order to open such closure element 34 the electromagnet 36 can have current applied thereto by means of the trigger 38 of the weapon 2. The duration of a beam pulse 6 is governed by a timing element 40, for instance, an RC-element, which is adjustable in conventional fashion. In this way it is possible to adjust the pulse duration to a value which corresponds to the time between firing a standard weapon until departure of the projectile out of the weapon barrel.

Now in FIG. 3 the weapon 2 is a conventional pistol which has been modified for performing simulated firing operations. To this end the pistol 2 contains a pulse transmitter 42 which is constructed as an adaptor or accessory device which can be inserted into the barrel 44 of the pistol. The accessory device constituting the pulse transmitter 42 is connected by means of a plug connection 46 with a switch 48*a*, constructed as a cartridge-like switch insert 48 which can be inserted into the barrel 44 of the weapon instead of the conventional cartridge. In the cartridge magazine 50 there is arranged a supply device 52 constructed as a magazine insert, this supply device 52 being connected by a contact tab or tongue 54 or equivalent structure with the switch insert 48. By removing the pulse transmitter 42, the switch insert 48 and the supply device 52 constructed as a magazine insert, the weapon can be again immediately used as a standard weapon.

The pulse transmitter 42 of the pistol-like weapon 2 possesses a radiation diode 56 serving as the radiation source, such diode for instance being a laser diode or an infrared diode. The radiation diode 56 is directly arranged in the tubular housing 58 of the adjustment device 60. The just-mentioned adjustment device 60 will be seen to contain a condenser 62 following which there is arranged an objective 64 for collecting and focusing the rays or beam. At the common focal point of the condenser 62 and the objective 64 there is arranged a diaphragm 66 in order to impart to the concentrated beam a substantially circular cross-sectional configuration. The objective 64 is arranged in a ring-shaped mounting or fixture 68 which can be adjusted at the tubular housing 58, for instance by means of a threading in axial direction, in order to thus adjust the outgoing beam pulse 70 at a not particularly here illustrated target image plane such that its hit diameter corresponds to the caliber of the weapon. The adjustment path of the objective 64 is calibrated such that the objective simply can be adjusted to the distance to the target device.

The switch insert 48 is constructed in the manner of a cartridge sleeve and consists of electrically insulating material. It contains at the side confronting the firing pin 78 a contact ring 72 which is connected with the contact tab 54 of the supply device 52. The contact ring 72 is connected with a first contact 74 situated opposite a second contact 76 which is connected with the plug connection 46. The firing pin 78, upon firing the weapon 2 and in the firing position, bridges the contacts 74 and 76, so that a current can flow from the power supply device 52 to the pulse transmitter 42. In contrast to the illustrated exemplary embodiment, the switch insert could be constructed such that the firing pin directly brings into contact two switching contacts.

Moreover, it is also possible, in contrast to the illustrated exemplary embodiments, to construct the switching or switch device for triggering the beam pulses in such a manner that it possesses a piezoelectric device for triggering the beam pulse and responsive to the impact of the firing pin. Such piezoelectric device could be arranged, for instance, in a power supply device which is arranged at the weapon and thus exposed to the impact of the firing pin.

FIG. 4 illustrates a target device 80 which contains at the target image plane Z a collecting lens 82 for transmitting a beam pulse 6 to a detector 84. Arranged in front of the detector 84 is an interference filter 86 for eliminating the effect of outside or spurious light and in front of such filter 86 there is arranged a dispersion or scattering lens 88. The optical device of the target device 80 incorporates the principle of the Galileo telescope. In front of the collecting lens 82 there is arranged at an inclination of about 45° to the path of the rays or beam a partially pervious mirror 90, in order to image a target image from a pattern 92. The beam pulse 6 which impinges at the target device 80 is deflected and focused by the collecting lens 82 at the detector 84. This detector 84 has a considerably smaller surface than the target image appearing in the target image plane Z.

Figure 5:
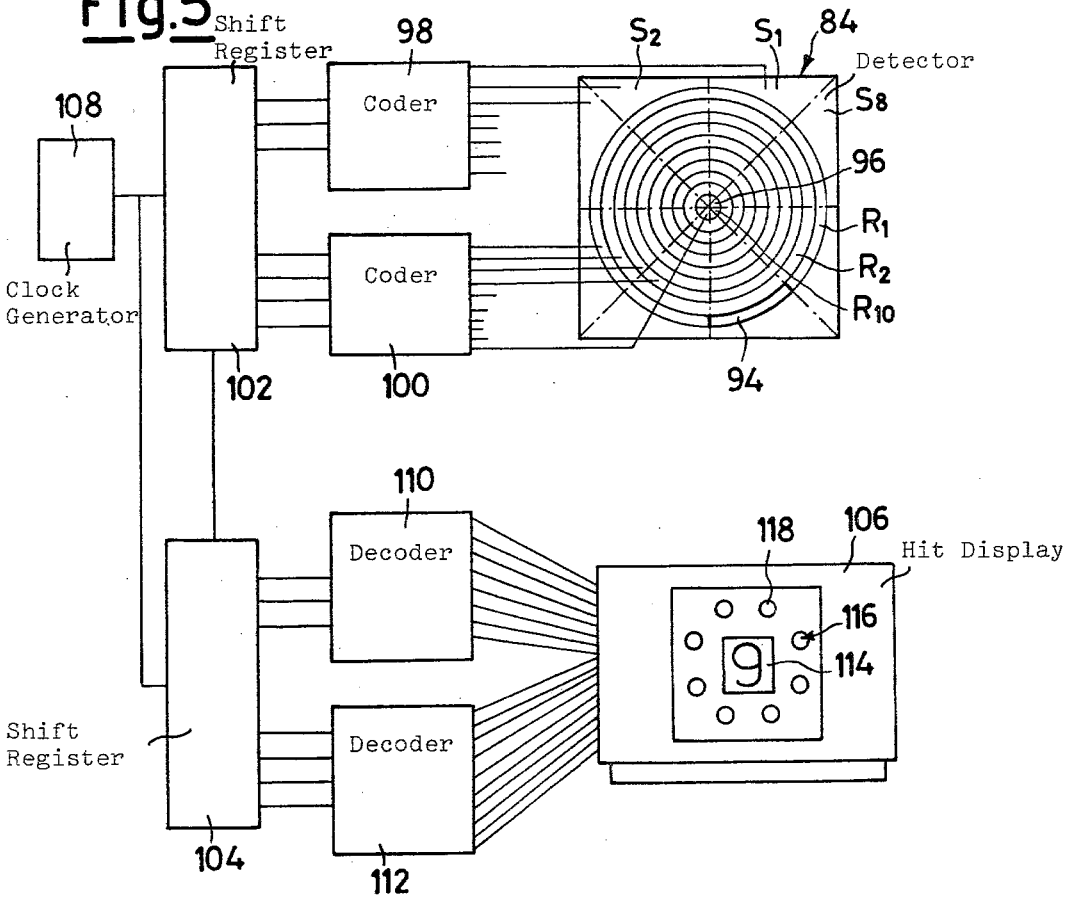
FIG. 5 is a block circuit diagram of a target device and a hit display shown in schematic illustration.

Now in FIG. 5 there is illustrated a block circuit diagram for the hit evaluation of the beam pulse arriving at the detector 84. The detector 84 is sub-divided in accordance with the target disk or target into rings $R_1$–$R_{10}$ and additionally into eight sectors $S_1$–$S_8$. Each ring section 94 as well as the center 96 are constructed as sensors for detected an impinging beam pulse. The sensors are preferably phototransistors formed on the basis of silicon. Further, the parts of the detector corresponding to the rings are constructed as collectors and the parts corresponding to the sectors as emitters. In order to evaluate the target hits, the individual collectors of the rings are connected with a first coder or coding device 98 and the emitters corresponding to the sectors with a second coder or coding device 100. These coders 98 and 100 are constructed such that as to the impinging beam pulses they only detect in each case the end of one such pulse. Additionally, the first coder 98 is constructed such that if a hit touches two rings, then there will only be evaluated the ring of higher value. In the coders, the received signals are coded after evaluation and supplied to a shift register 102. This shift register 102 is connected with a further shift register 104 of a hit display or indicator 106. In order to trigger the shift registers 102 and 104 there is provided a common clock generator 108. Arranged after the shift register 104 of the hit display 106 is a first decoder 110 and a second decoder 112 which decipher the coded signals and deliver such to the display devices 114 and 116. In the display device 114 the hit ring value is digitally displayed, whereas the display device 116 comprises eight display lamps 118 or equivalent structure which are arranged in accordance with the sector positions of the target disk or target and always then illuminate when the hit is located in the corresponding sector of the target.

It is possible to also evaluate other target images or target sub-divisions by utilizing the same principles.

Now in FIGS. 6 and 7 there are illustrated further target devices utilizing as the collecting lenses an aspherical lens 120 and a Fresnel lens 122, respectively.

FIG. 8 illustrates a further construction of target device 124 having a hit display 126. The target device 124 comprises a television camera 128 having a collecting lens 130 arranged forwardly thereof in the target image plane Z. The television camera 128 is preferably a semiconductor camera equipped with a number of semiconductors corresponding to the image points, so that certain image regions have correlated therewith certain semiconductors. The hit display 126 is constructed as a monitor where, by means of an appropriate device, there can be adjustably focused a target image 132. In this way it is possible to accurately indicate at each location of the target image the hits so that it is unnecessary to sub-divide the target image into sectors. It is also advantageous to equip the hit display 126 with a microprocessor 220 and a digital display 230 which, for instance, determines and digitally displays the ring value of the hit ring of a target.

Finally, there is schematically shown in FIG. 9 a facet 134 of a collecting lens constructed as a facet lens. One such facet 134 enables evaluating the facet region with a practically point-shaped sensor 136.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A system for simulating firing of a weapon, comprising:

a pulse transmitter capable of being connected with a weapon and serving for transmitting beam pulses;

a target device having a target image plane and cooperating with the pulse transmitter;

a hit display for the target device for displaying target hits;

a calibrated adjustment device provided for the pulse transmitter for adjustment of the beam pulses in order to adjust their hit diameter at the target image plane of the target device to the caliber of the weapon used for simulation firing;

said target device comprising a target image subdivided into target regions;

a detector provided for each target region;

each detector having a sensor responsive to a beam pulse impinging thereat;

each sensor has a surface which is smaller than the correlated target region of the target image;

an optical means arranged between the target image plane and the detector formed by the sensors; and said optical means serving for the deflection and the proportional size reduction of a beam pulse at the sensors and which beam pulse impinges upon the target image plane.

2. The system as defined in claim 1, further including:

collecting lens means arranged at the target image plane.

3. The system as defined in claim 2, wherein:

said collecting lens means comprises a Fresnel lens.

4. The system as defined in claim 2, wherein:

said collecting lens means comprises an aspherical lens.

5. The system as defined in claim 2, wherein:

said collecting lens means comprises a facet lens having a number of facets; and a sensor arranged at the focal point of each facet.

6. The system as defined in claim 1, wherein:

forwardly of the detector, there is arranged an optical device tuned to the beam pulses and serving to eliminate the effects of outside light.

7. The system as defined in claim 6, wherein:

said eliminating means comprises an interference filter.

8. The system as defined in claim 7, wherein:

said interference filter comprises an interference filter foil.

9. The system as defined in claim 8, further including:

at least one collecting lens arranged in the target image plane;

said interference filter foil being disposed at a rear face of the collecting lens.

10. A system for simulating firing of a weapon, comprising:

a pulse transmitter capable of being connected with a weapon and serving for transmitting beam pulses;

a target device having a target image plane and cooperating with the pulse transmitter;

a hit display for the target device for displaying target hits;

a calibrated adjustment device provided for the pulse transmitter for adjustment of the beam pulses in order to adjust their hit diameter at the target image plane of the target device to the caliber of the weapon used for simulation firing;

said target device comprising a target image subdivided into target regions;

a detector provided for each target region;

each detector having a sensor responsive to a beam pulse impinging thereat;

said target device including a target disk serving as a target image;

said target disk being sub-divided into rings and sectors;

said detector being provided with said sensors in accordance with sections of said rings;

said sensors of the detector comprising phototransistors having collectors and emitters; and said collectors defining said rings and said emitters defining said sectors.

11. The system as defined in claim 10, wherein:

said target device includes evaluation means;

said evaluation means comprising a first coder connected with said rings and a second coder connected with said sectors;

a first shift register;

a second shift register connected with said first shift register;

decoder means arranged after said second shift register and connected therewith;

said first and second coders delivering ring and sector signals to said first shift register;

said ring and sector signals being coded in accordance with a hit ring section.

12. The system as defined in claim 11, wherein:

said first coder delivers a higher ring value to the first shift register when a hit strikes two rings.

13. The installation as defined in claim 11, wherein:

said hit display is structured for the display of the hit rings and sectors.

14. The system as defined in claim 13, wherein:

said hit display digitally displays the hit ring value.

15. The system as defined in claim 13, wherein:

said hit display provides an analogue display of the hit sectors.

16. A system for simulating firing of a weapon, comprising a pulse transmitter connected with an electrical supply device and having an optical adjustment device for transmitting and adjusting beam pulses, in order to adjust their impact diameter in the target image plane of a target device having a hit display to the caliber of the weapon, said supply device possessing an adjustable electrical timing means including an RC element in order to be able to adjust the duration of the beam pulse to a value which corresponds to the time span between firing the weapon until the projectile departs from the weapon barrel.

17. The system as defined in claim 16, further including:

evaluation means provided for the target device for each detected beam pulse;

said evaluation means including mechanism for evaluating only the end of a beam pulse.

18. A system for simulating firing of a weapon, according to claim 11, wherein said optical adjustment device possesses lenses operatively associated with said laser-pulse transmitter for enlarging the beam pulse as well as subsequently arranged lenses for focusing the transmitted beam pulse.

19. The system for simulating firing according to claim 18, characterized by the features that the lenses for focusing the transmitted beam pulse are displaceable for adjusting the beam pulse in the optical axis.

20. The system for simulating firing according to claim 18, characterized by the features that the laser is a helium-neon laser.

21. A system for simulating firing of a weapon, comprising a pulse transmitter connected with an electrical supply device and having an optical adjustment device for transmitting and adjusting beam pulses in order to adjust their hit diameter in the target image plane of a target device having a hit display to the caliber of the weapon, and a cartridge-like switch insert insertable into the barrel of the weapon, having two contacts which are bridged by the firing pin of the weapon in the firing position.

22. The system for simulated firing according to claim 21, characterized by the features that the switch insert comprises a sleeve of electrically insulating material having a contact ring, and wherein the contact ring cooperates with a contact tab of a supply device for the pulse transmitter.

23. The system for simulating firing according to claim 21, characterized by the features that the switch insert is connected by means of a plug connection electrically with the pulse transmitter.

24. The system for simulating firing according to claim 21, characterized by the features that the pulse transmitter is constructed together with its optical adjustment device as an attachment which is insertable into the barrel of the weapon.

* * * * *